US010722913B2

(12) United States Patent
Jensen et al.

(10) Patent No.: US 10,722,913 B2
(45) Date of Patent: Jul. 28, 2020

(54) LIQUID EJECTION APPARATUS

(71) Applicant: ALFA LAVAL CORPORATE AB, Lund (SE)

(72) Inventors: Bo Boye Busk Jensen, Rödovre (DK); Leon Hjorslev, Greve (DK)

(73) Assignee: ALFA LAVAL CORPORATE AB, Lund (SE)

( * ) Notice: Subject to any disclaimer, the term of this patent is extended or adjusted under 35 U.S.C. 154(b) by 331 days.

(21) Appl. No.: 15/538,406

(22) PCT Filed: Dec. 18, 2015

(86) PCT No.: PCT/EP2015/080497
§ 371 (c)(1),
(2) Date: Jun. 21, 2017

(87) PCT Pub. No.: WO2016/102367
PCT Pub. Date: Jun. 30, 2016

(65) Prior Publication Data

US 2017/0348722 A1 Dec. 7, 2017

(30) Foreign Application Priority Data

Dec. 22, 2014 (EP) ..... 14199732

(51) Int. Cl.
*B05B 15/55* (2018.01)
*B05B 15/555* (2018.01)
(Continued)

(52) U.S. Cl.
CPC ..... *B05B 15/555* (2018.02); *B05B 3/0445* (2013.01); *B08B 9/0936* (2013.01)

(58) Field of Classification Search
CPC combination set(s) only.
See application file for complete search history.

(56) References Cited

U.S. PATENT DOCUMENTS 3,565,342 A 2/1971 Orem et al.
5,056,716 A * 10/1991 Robinson ..... B08B 9/093 134/168 R (Continued)

FOREIGN PATENT DOCUMENTS

CN 2238093 Y 10/1996
CN 1339990 A 3/2002

(Continued)

OTHER PUBLICATIONS

Espacenet translation DE 102004052794, Container cleaning device has a planetary gear, Hacked 2005 (Year: 2005).*

(Continued)

*Primary Examiner* — Cristi J Tate-Sims
(74) *Attorney, Agent, or Firm* — Buchanan Ingersoll & Rooney PC

(57) ABSTRACT

A liquid ejection apparatus for cleaning of a tank. The liquid ejection apparatus comprising: a base member having a first end for receiving the liquid from a liquid line, a rotary head that is rotatably connected to the base member and a rotary nozzle hub that is rotatably connected to the rotary head. The rotary nozzle hub comprises a primary liquid ejection nozzle for ejecting a liquid in a pattern towards an interior surface of the tank, and a secondary liquid ejection nozzle that is configured to, during at least a part of a revolution of the rotary nozzle hub, eject the liquid in a pattern towards an external surface of the base member.

19 Claims, 5 Drawing Sheets

(51) Int. Cl.

| | |
|---|---|
| ***B05B 3/04*** | (2006.01) |
| *B08B 9/093* | (2006.01) |

(56) References Cited

U.S. PATENT DOCUMENTS

| | | | | |
|---|---|---|---|---|
| 5,301,702 | A * | 4/1994 | McKinney | B05B 3/06 134/107 |
| 5,333,630 | A | 8/1994 | Jepsen et al. | |
| 5,460,193 | A * | 10/1995 | Levallois | B08B 9/0936 134/167 R |
| 6,460,553 | B1 | 10/2002 | Owens et al. | |
| 8,066,823 | B2 | 11/2011 | Ross | |
| 8,177,917 | B2 | 5/2012 | Lindros | |
| 2002/0124872 | A1 | 9/2002 | Ura | |
| 2009/0260661 | A1 | 10/2009 | Lindros | |
| 2010/0043849 | A1 | 2/2010 | Ross | |
| 2012/0017951 | A1 | 1/2012 | Ross et al. | |
| 2015/0298182 | A1 | 10/2015 | Kjellberg et al. | |
| 2017/0120312 | A1* | 5/2017 | Hoffnneyer | B05B 3/04 |

FOREIGN PATENT DOCUMENTS

| | | | |
|---|---|---|---|
| CN | 101378852 | A | 3/2009 |
| DE | 198 11 421 | A1 | 9/1999 |
| DE | 10 2004 052 794 | B3 | 10/2005 |
| GB | 623780 | | 5/1949 |
| WO | 99/47271 | A1 | 9/1999 |
| WO | 2002/024317 | A1 | 3/2002 |
| WO | WO 2006/048067 | A1 | 5/2006 |
| WO | WO 2007/090395 | A1 | 8/2007 |
| WO | WO 2008/060223 | A1 | 5/2008 |
| WO | WO 2014/072087 | A1 | 5/2014 |

OTHER PUBLICATIONS

International Search Report (PCT/ISA/210) dated Mar. 8, 2016, by the European Patent Office as the International Searching Authority for International Application No. PCT/EP2015/080497.

Written Opinion (PCT/ISA/237) dated Mar. 8, 2016, by the European Patent Office as the International Searching Authority for International Application No. PCT/EP2015/080497.

An English Translation of the Office Action (First Office Action) dated Aug. 14, 2018, by the State Intellectual Property Office (SIPO) of the People's Republic of China in corresponding Chinese Patent Application No. 201580070040.6 (6 pages).

European Extended Search Report dated Jul. 21, 2017, by the European Patent Office in corresponding European Application No. 17168593.6-1760. (6 pages).

* cited by examiner

LIQUID EJECTION APPARATUS

TECHNICAL FIELD

The present invention relates to a liquid ejection apparatus for internal cleaning of tanks and/or for mixing of contents in tanks, and in particular to a liquid ejection apparatus having liquid ejection nozzles for improved cleaning.

BACKGROUND ART

Liquid containment tanks or containers are used in a number of industrial processes such as food manufacturing, pharmaceutical manufacturing, chemical processing, material fermentation and so on. It is often critical to ensure that the interior of the tank is free of unwanted debris and contaminants. For example, a tank that is typically filled to a certain level may exhibit a "tub ring" about its interior circumference at the level to which the tank is most often filled. Also, various equipment within a tank, tank inlets and outlets etc. may trap sediment or debris that may later reenter the tank contents during use.

Unwanted contaminants in the tank may negatively influence the quality of the finished product being manufactured, processed or stored in the tank. Also, the interior of a tank must be properly cleaned if regulations applying to certain industries such as pharmaceutical industries shall be followed. Thus, it is common to clean the interior of such tanks at certain intervals, e.g. after each process batch, to ensure product quality and adherence to any relevant regulations.

Tank cleaning systems are available that clean debris and residue from the interior of tanks and other vessels through the use of what is commonly known as impingement cleaning. One common type of such systems employs a cleaning apparatus that is inserted into the tank and which has a hose or pipe that extends into the tank. At an end of the pipe protruding into the tank, a rotary jet head is affixed. The rotary jet head is commonly rotatable about one or two axes and, in the latter case, is typically geared such that as the jet head rotates about an axis of the pipe, it also turns upon an axis perpendicular to the pipe.

A relationship between rotations about two axes depends on a gearing ratio, which is selected such that a combination of a particular orientation and position of the jet head repeats only after multiple revolutions around the axis of the pipe. This technique staggers subsequent traces of the spray against a tank interior on each revolution of the rotary head to ensure that substantially every portion of the tank interior is exposed to the cleaning spray at some time during the cleaning process. The accomplished traces of the spray against the tank provide a cleaning apparatus that sprays cleaning liquid in a predetermined pattern on the interior surface of the tank.

In order to ensure that the interior of a tank is adequately cleaned the cleaning liquid should be sprayed in a predetermined pattern. Alternatively, a cleaning duration may be prolonged, which however may lead to excessive waste of time, cleaning fluid, and energy.

A tank cleaning apparatus is commonly a fixed installation in the sense that it is seldom or even never removed from the tank in which it is installed. This means that also the tank cleaning apparatus itself preferably shall be cleaned during a cleaning process in order to not complicate the cleaning process by e.g, requiring a separate subsequent cleaning of the cleaning apparatus. An unsatisfactory cleaned cleaning apparatus may result in that debris and residues are remaining on the cleaning apparatus after a completed cleaning process. Such remaining debris and residues may later on reenter contents of the tank resulting in that the contents may become negatively affected or contaminated.

To ensure an adequate cleaning of the tank and the cleaning apparatus different techniques have been suggested and employed. For example, patent document US 2012/0017951 A1 discloses a tank cleaning system utilizing nozzles to provide flush liquid streams on an interior surface of an enclosed space, like a tank. One or more of the nozzles used are arranged in an angled fashion such that the flush liquid streams from the angled nozzles impinge on the liquid pipe, on which the cleaning apparatus is mounted, to some extent thereby providing a cleaning effect to the liquid pipe. Patent document, WO 2014/072087 A1, on the other hand, discloses how cleaning is improved by employing nozzles having a dual spray pattern, resulting in that the interior of the tank is cleaned as well as the fluid line on which the cleaning apparatus is mounted. This is achieved by the dual spray pattern which is designed such that both the interior of the tank and the liquid pipe, on which the cleaning apparatus is mounted, is sprayed to some extent.

The cleaning apparatus may also be used for mixing a content of the tank. This is typically done by filling the tank with the content until the rotary jet head is fully underneath a surface of the content. The content is then mixed by circulating it from an outlet of the tank and back into the tank via the rotary jet head. As with cleaning, mixing must be adequately performed and it is important that this may be done without e.g. excessive circulation of content. When a tank cleaning apparatus is capable of also performing mixing of a content of the tank, the apparatus is often referred to as a liquid ejection apparatus rather than a cleaning apparatus.

Present techniques provide solutions for cleaning of the interior of tanks and mixing of contents of a tank. Moreover, present techniques provide solutions for cleaning the pipe or liquid line onto which the cleaning apparatus or liquid ejection apparatus is mounted. However, in some cases the cleaning of the cleaning apparatus itself has proven to be non satisfactory, resulting in that debris or residues remain on the cleaning apparatus even after a completed cleaning process. If debris or residues remain on the cleaning apparatus after a cleaning process, this may result in that the contents of the tank are negatively affected or contaminated during subsequent use of the tank.

Hence, there is a need for an improved liquid ejection apparatus.

SUMMARY

It is an object of the invention to improve the above techniques and the prior art. In particular, it is an object to provide a liquid ejection apparatus that may improve cleaning of the liquid ejection apparatus itself during use. In other words, in particular, it is an object to provide a liquid ejection apparatus with improved self-cleaning properties.

To solve these objects a liquid ejection apparatus for cleaning of a tank is provided according to a first aspect. The liquid ejection apparatus being configured to be attached to a liquid line that extends into the tank, and to receive a liquid from the liquid line, the liquid ejection apparatus comprising: a base member having a first end for receiving the liquid from the liquid line, and a second end, wherein an outer circumference of a section of the base member increases in a direction towards the second end, a rotary head that is rotatably connected to the second end of the base member, a rotary nozzle hub that is rotatably connected to the rotary head and comprises a primary liquid ejection nozzle for ejecting the liquid, the rotary head being rotatable about a first geometrical axis and the rotary nozzle hub being rotatable about a second geometrical axis that is arranged at an angle relative to the first geometrical axis, such that the liquid ejected by the primary liquid ejection nozzle is ejected in a pattern towards an interior surface of the tank, wherein the rotary nozzle hub comprises a secondary liquid ejection nozzle that is configured to, during at least a part of a revolution of the rotary nozzle hub, eject the liquid in a pattern towards an external surface of the base member.

The liquid ejection apparatus is advantageous in that the primary liquid ejection nozzle and the secondary liquid ejection nozzle provide efficient cleaning of the interior of the tank as well as of the liquid ejection apparatus itself. The efficient cleaning of the tank is achieved mainly by the primary liquid ejection nozzle but also to some extent in combination with the secondary liquid ejection nozzle, by ejecting the liquid in a pattern towards the interior surface of the tank. The cleaning of the liquid ejection apparatus itself is achieved by the secondary liquid ejection nozzle which ejects the liquid in a pattern towards an external surface of the base member during at least a part of a revolution of the rotary nozzle hub. By ejecting liquid in a pattern towards an external surface of the base member, the base member will be efficiently cleaned. Further, the liquid ejected towards the base member will impinge on the base member and thereafter follow the external surface of the base member, meaning that the liquid will continue to flow down along the base member and onto the rotary head. This means that also the rotary head will be indirectly cleaned by the liquid ejected from the secondary liquid ejection nozzle. The liquid ejected from the secondary liquid ejection nozzle will continue further and also provide a cleaning effect to the rotary nozzle hub and its nozzles. The use of the primary liquid ejection nozzle and the secondary liquid ejection nozzle may in a mixing process also provide for efficient mixing of a content of the tank.

The primary liquid ejection nozzle may have an outlet that is larger than an outlet of the secondary liquid ejection nozzle, such that a liquid flow through the primary liquid ejection nozzle may be at least 8 times greater than a liquid flow through the secondary liquid ejection nozzle, which is advantageous in that efficient cleaning of the liquid ejection apparatus itself may be achieved while still using only a limited additional amount of liquid for this. The use of a limited amount of liquid for cleaning the liquid ejection apparatus brings about that less liquid- and energy-consuming cleaning may be performed. The cleaning of the liquid ejection apparatus thus becomes more economical.

An outlet of the secondary liquid ejection nozzle may be in flush with an external surface of the rotary nozzle hub, which is advantageous in that a solution resulting in fewer protruding elements may be realized. By having fewer elements protruding from the rotary nozzle hub, the risk of trapping and accumulating debris or residues is reduced. Moreover, a robust solution with a decreased sensitivity to external influences, such as pressure, mechanical impact and the like, may be realized.

The secondary liquid ejection nozzle may be formed as a through hole in a wall of the rotary nozzle hub, which is advantageous in that a cost efficient and reliable solution may be achieved.

The secondary liquid ejection nozzle and a connection between the primary liquid ejection nozzle and the rotary nozzle hub may be arranged on an annular envelope surface of the rotary nozzle hub, the annular envelope surface having a width that is equal to or smaller than an outer width of the primary liquid ejection nozzle at the connection between the primary liquid ejection nozzle and the rotary nozzle hub. By this arrangement a compact design of the liquid ejection apparatus is achieved. A compact design may result in a stronger construction requiring less material during manufacture. Moreover, a compact design may require less space during installation and use, allowing the cleaning apparatus to be inserted through relative small holes in existing tanks.

The rotary nozzle hub may comprise an internal cavity in liquid communication with the rotary head, wherein an inlet of the secondary liquid ejection nozzle and an inlet of the primary liquid ejection nozzle are separated from each other and formed in a wall of the internal cavity, which is advantageous in that the fluid may be fed to the respective nozzles in an efficient and reliable manner.

An inlet of the secondary liquid ejection nozzle and an inlet of the primary liquid ejection nozzle may be arranged within a disk shaped volume centered on and extending radially and perpendicularly from the second geometrical axis, and having a width that is equal to an outer width of the primary liquid ejection nozzle at a connection between the primary liquid ejection nozzle and the rotary nozzle hub, which is advantageous in that a compact design of the internal cavity of the nozzle hub and consequently the liquid ejection apparatus may be achieved.

An outlet of the secondary liquid ejection nozzle and an outlet of the primary liquid ejection nozzle may be arranged within a disk shaped volume centered on and extending radially and perpendicularly from the second geometrical axis, and having a width that is equal to an outer width of the primary liquid ejection nozzle at a connection between the primary liquid ejection nozzle and the rotary nozzle hub, which is advantageous in that a compact design of the liquid ejection apparatus may be achieved. A compact design may result in a stronger construction requiring less material during manufacture.

The primary liquid ejection nozzle may have an outer, concave surface that faces the rotary head. Thus, the concave surface may have a normal direction with a component that is directed towards the rotary head. This is advantageous in that a flow of the liquid on the outer concave surface of the primary nozzle may follow the outer concave surface thereby cleaning the primary liquid ejection nozzle. It should be noted that within the context of this application the term "outer concave surface" may be any outer surface of the primary liquid ejection nozzle exhibiting a concave portion when defining a cross section through the primary nozzle along a longitudinal direction thereof. The longitudinal direction of the nozzle may be defined as the direction from an inlet of the nozzle to an outlet of the nozzle. In other words, a cross section of the primary liquid ejection nozzle in a plane defined by a radial direction of the rotary nozzle hub and the second geometrical axis may have a concave portion defining the cross section in a direction facing the rotary head.

The liquid ejection apparatus may comprise a gap located between the base member and the rotary head, for allowing an amount of the liquid to flow out from the gap, wherein the outer, concave surface of the primary liquid ejection nozzle is positioned such that a flow of the liquid from the gap impinges on the outer, concave surface of the primary liquid ejection nozzle during at least a part of a revolution of the rotary nozzle hub, which is advantageous in that a forced flow of liquid exhibiting a cleaning effect on the primary liquid ejection nozzle may be achieved.

The gap may direct the liquid towards a curved section of the rotary head, the curved section directing the liquid towards a liquid exit surface of the rotary head, the liquid exit surface having a tangential direction that directs the liquid towards the concave surface of the primary liquid ejection nozzle, during at least a part of a revolution of the rotary nozzle hub, which is advantageous in that a forced flow of liquid exhibiting a cleaning effect on the primary liquid ejection nozzle may be achieved.

The liquid ejection apparatus may comprise a plurality of primary liquid ejection nozzles that are arranged on the rotary nozzle hub, such that interspaces are formed between the primary liquid ejection nozzles, and a plurality of secondary liquid ejection nozzles that are located on a respective interspace of the interspaces between the primary liquid ejection nozzles. By this arrangement, the cleaning effect and the mixing effect may be enhanced. The use of a plurality of primary liquid ejection nozzles and a plurality of secondary liquid ejection nozzles allows for a more dense pattern having a plurality of liquid jets being ejected in a pattern towards an interior surface of the tank. This results in that a time needed for a cleaning may be reduced. Moreover, by locating the secondary liquid ejection nozzles on the respective interspaces, a compact design may be achieved.

The liquid ejection apparatus may comprise a plurality of secondary liquid ejection nozzles, wherein a first, secondary liquid ejection nozzle is inclined towards the rotary head with an angle of 10° to 50° relative the first geometrical axis, such that that liquid ejected by the first, secondary liquid ejection nozzle is, during at least a part of a revolution of the rotary nozzle hub, ejected in a pattern towards an external surface of the base member, and wherein a second, secondary liquid ejection nozzle may be inclined towards the rotary head with an angle of 1° to 10° relative the first geometrical axis, such that liquid ejected by the second, secondary liquid ejection nozzle is, during at least a part of a revolution of the rotary nozzle hub, ejected in a pattern towards an external surface of the liquid line that extends into the tank. The use of a first, secondary liquid ejection nozzle and a second, secondary liquid ejection nozzle is advantageous in that the cleaning of the liquid line that extends into the tank may be enhanced, as liquid may be ejected in a pattern towards an external surface of the liquid line. It should be noted that within the context of this application the wording "inclined towards the rotary head with an angle relative the first geometrical axis" may refer to any angle towards the rotary head (and the first geometrical axis) when the outlet of the secondary liquid ejection nozzle is directed towards the first geometrical axis.

A shortest distance from a central, longitudinal axis of the base member and the secondary liquid ejection nozzle may be between 65 and 120 mm, which is an advantageous range in that it provides for an optimization of the design.

A circumference of the rotary head may be, at an end of the rotary head facing the nozzle hub, at least 20% larger than a circumference of the rotary nozzle hub, at a section of the rotary nozzle hub where the rotary nozzle hub meets the rotary head, which is advantageous in a design that has been optimized in respect of its relative size may be achieved.

An external envelope surface of the primary liquid ejection nozzle may have a first circumference at any first radial distance from the rotary nozzle hub and a second circumference that is equal to or smaller than the first circumference, at any second radial distance from the rotary nozzle hub, the second radial distance being larger than the first radial distance.

According to a second aspect, there is provided a liquid ejection apparatus for cleaning of a tank. The liquid ejection apparatus being configured to be attached to a liquid line that extends into the tank, and to receive a liquid from the liquid line, the liquid ejection apparatus comprising: a base member having a first end for receiving the liquid from the liquid line, and a second end, wherein an outer circumference of a section of the base member increases in a direction towards the second end, a rotary head that is rotatably connected to the second end of the base member, a rotary nozzle hub that is rotatably connected to the rotary head and comprises a primary liquid ejection nozzle for ejecting the liquid, the rotary head being rotatable about a first geometrical axis and the rotary nozzle hub being rotatable about a second geometrical axis that is arranged at an angle relative to the first geometrical axis, such that the liquid ejected by the primary liquid ejection nozzle is ejected in a pattern towards an interior surface of the tank, wherein the primary liquid ejection nozzle has an outer, concave surface that faces the rotary head. Generally, the second aspect may incorporate any of the above features as discussed in conjunction with the liquid ejection apparatus according the first aspect. Moreover, features of the second aspect of the apparatus generally provide similar advantages as discussed above in relation to the first aspect of the apparatus.

Further features of, and advantages with, the present invention will become apparent when studying the appended claims and the following description. The skilled person will realize that different features of the present invention may be combined to create embodiments other than those described in the following, without departing from the scope of the present invention.

BRIEF DESCRIPTION OF THE DRAWING

Embodiments of the invention will now be described, by way of example, with reference to the accompanying schematic drawings, in which.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
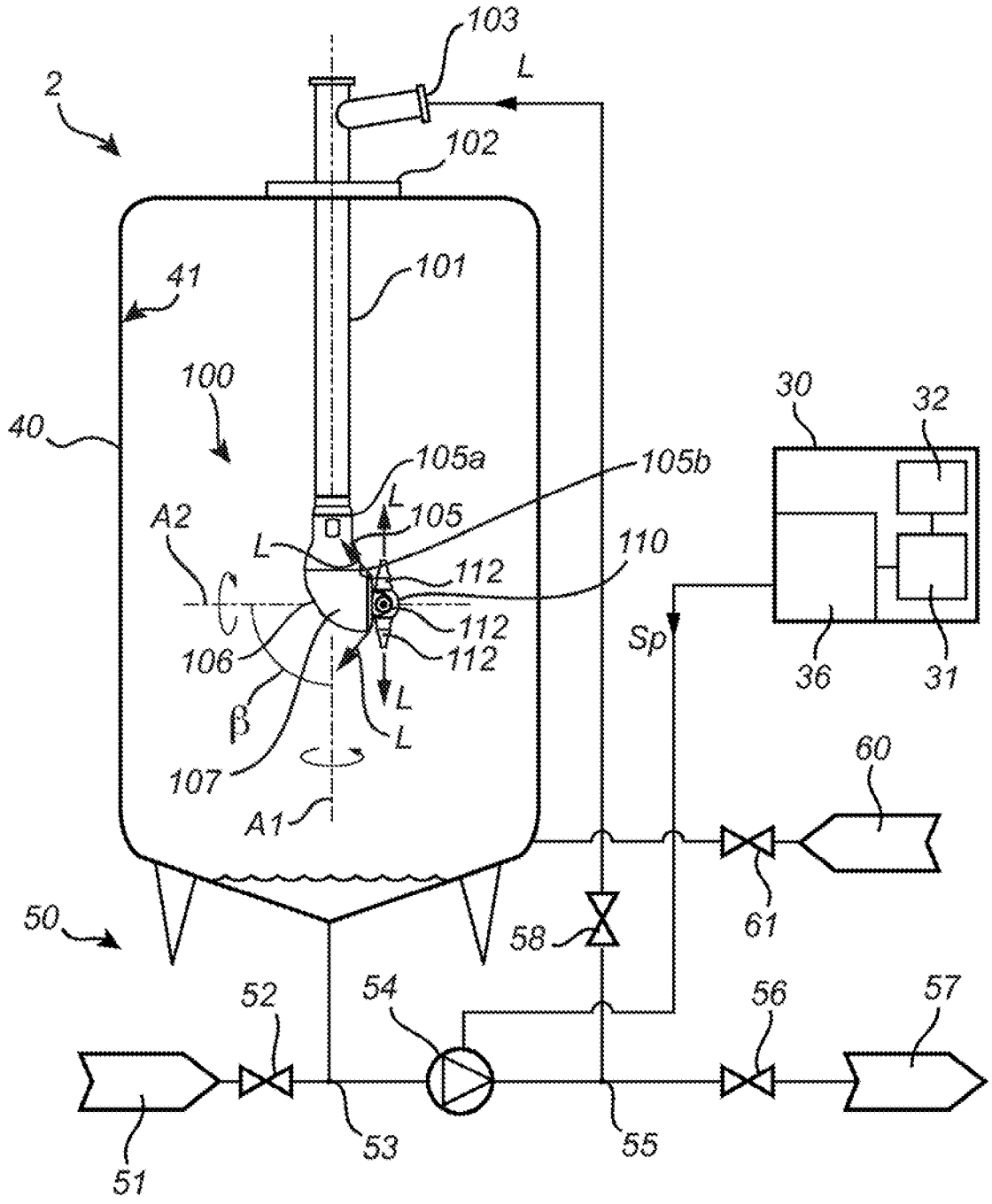
FIG. 1 is a schematic view of a liquid ejection system including a liquid ejection apparatus for cleaning an interior surface of a tank and for mixing a content of a tank.

Referring now to the drawings and to FIG. 1 in particular, there is conceptually depicted an embodiment of a liquid ejection system 2 that is configured to eject a liquid L inside a tank 40. The liquid ejection system 2 comprises a liquid ejection apparatus 100, and a processing unit 30 that is configured to control a flow of the liquid L and thereby indirectly control the operation of the liquid ejection apparatus 100. When the liquid ejection apparatus 100 is operated by the flow of the liquid L, the liquid ejection apparatus 100 will eject the liquid L into the tank 40 in a predetermined pattern. The liquid ejection apparatus 100 of the depicted embodiment is thus driven by the flow of the liquid L.

The liquid ejection apparatus 100 has a liquid line 101 in form of a pipe that extends into the tank 40 via an opening in an upper portion of the tank 40. The liquid line may be e.g. a hose instead of pipe. The liquid line 101 is provided with a flange 102 that provides a secure connection as well as a tight seal to the tank 40. An upper portion of the liquid line 101, i.e. a portion that is outside the tank 40, is provided with an inlet 103 for receiving the liquid L. A lower portion of the pipe 101, i.e. a portion that extends into the tank 40, is at its end connected to the liquid ejection apparatus 100.

The liquid ejection apparatus 100 comprises a base member 105 which is attached to the liquid line 101. The base member 105 of the depicted embodiment has a section with a tapered or frustoconical shape with a narrower portion facing the liquid line 101. In other words, an outer circumference of the base member 105 in vicinity of the first end or upper end 105*a* is smaller than an outer circumference of the base member in vicinity of the second end or lower end 105*b*.

A rotary head 106 is rotatably connected to the lower end 105*b* of the base member 105. The rotary head 106 comprises a, housing 107 and is rotatable around a first geometrical axis A1 which is parallel to and coinciding with a longitudinal extension the liquid line 101.

Figure 5:
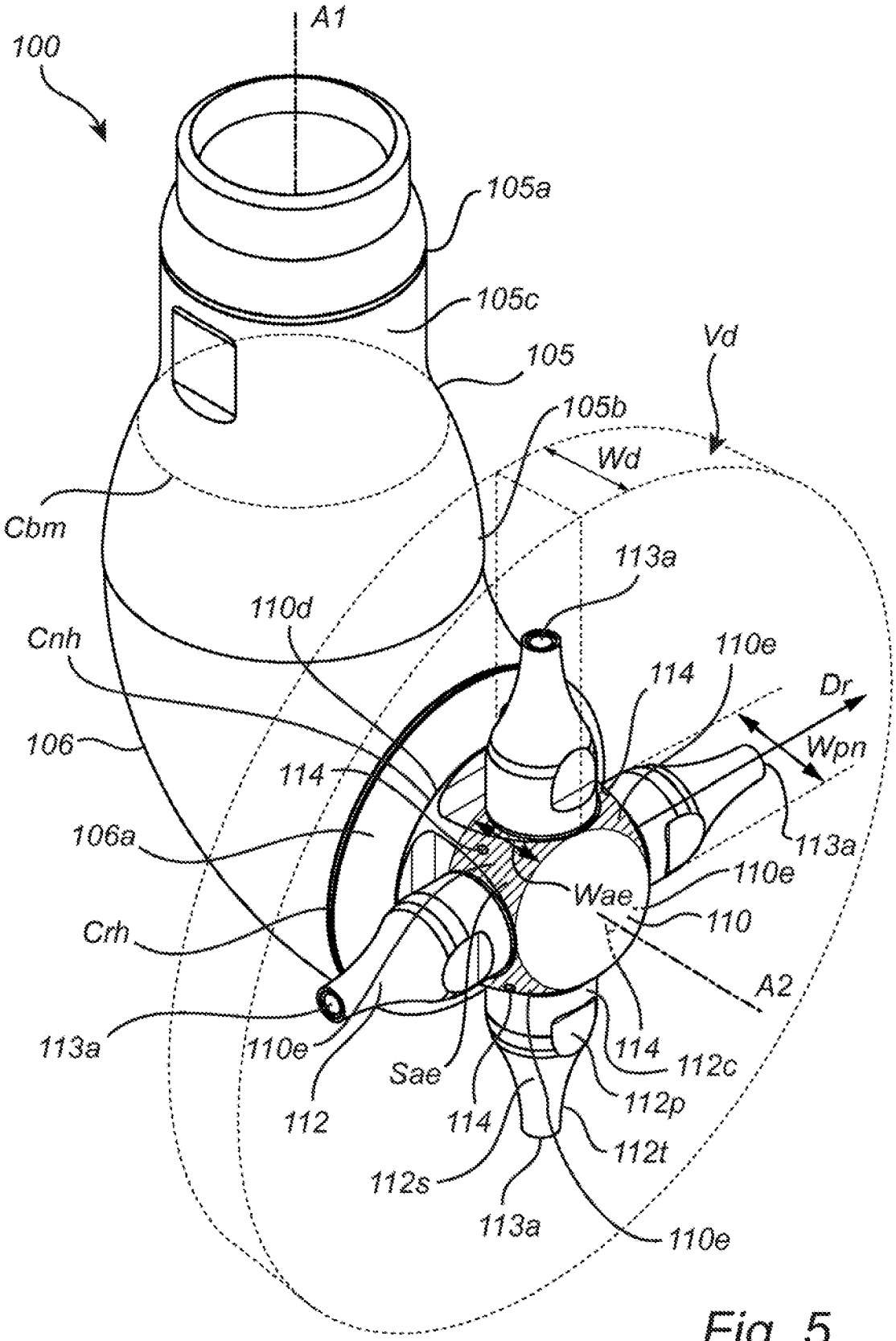
FIG. 5 is a perspective view of the liquid ejection apparatus of FIG. 1.
Figure 6:
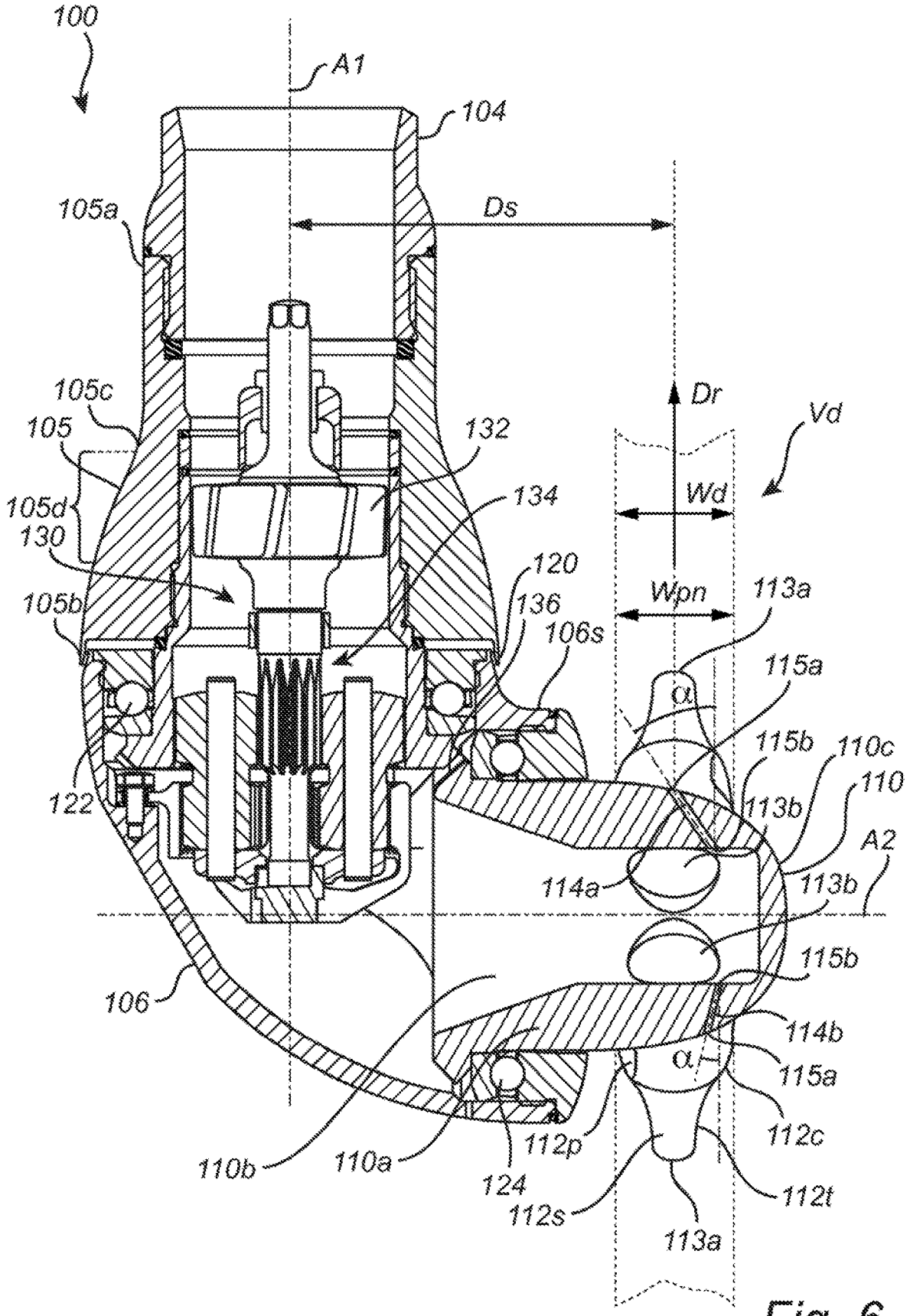
FIG. 6 is a first cross sectional side view of the liquid ejection apparatus of FIG. 1.

With further reference to FIGS. 5 and 6, a first bearing 122 is arranged between the base member 105 and an inlet end of the rotary head 106 which faces the base member 105, such that the rotary head 106 may rotate relative to the base member 105.

The rotary head 106 comprises a rotary nozzle hub 110 on which a number of primary liquid ejection nozzles 112 and a number of secondary liquid ejection nozzles 114, 114*a*, 114*b* are arranged. In the illustrated embodiment there are four primary liquid ejection nozzles and four secondary liquid ejection nozzles.

A second bearing 124 is arranged in between the rotary nozzle hub 110 and an outlet end of the rotary head 106 which faces the rotary nozzle hub 110, such that the rotary nozzle hub 110 may rotate relative to the rotary head 106. The second bearing 124 allows the rotary nozzle hub 110 to rotate about a second geometrical axis A2 that is typically offset from the first geometrical axis A1 by an angle β of 80°-100°. In the depicted embodiment the second axis A2 is arranged at an angle β of 90° relative to the first geometrical axis A1. Thus, the rotary nozzle hub 110, the primary nozzles 112 and the secondary nozzles are able to rotate about the first axis A1 and about the second axis A2, as seen relative the liquid line 101 or relative the tank 40.

The inlet 103 and the liquid line 101 each have the principal shape of a conventional pipe and are capable of transporting liquid L to be ejected into the tank 40, hi the illustrated embodiment the liquid ejection apparatus 100 is connected to the liquid line 101 via a connection element 104, for example by conventional welding or by matching threads. Liquid L enters the inlet 103, and is via the connection element 104 conveyed into the pipe 101 and towards the liquid ejection apparatus 100. The liquid L then enters the liquid ejection apparatus 100 through the base member 105 and continues into the rotary head 106 at the rotary head's connection to the base member 105 and exits the rotary head 106 at the rotary head's connection to the rotary nozzle hub 110. The rotary nozzle hub 110 thus receives liquid from the rotary head 106 and distributes liquid L further to the primary nozzles 112 and the secondary nozzles 114, 114*a*, 114*b*, which eject the liquid L into the tank 40 such that liquid L hits or impinges on an interior surface 41 of the tank 40, when cleaning is performed. Alternatively the nozzles 112 eject the liquid L into the tank 40 such that the liquid L is streamed into a content of the tank, towards the interior surface 41 of the tank 40, when mixing is performed. Liquid L ejected by at least one of the secondary liquid ejection nozzles is at least during a part of a revolution of the rotary nozzle hub 110, ejected in a pattern towards an external surface of the base member 105 and impinges thereon when cleaning is performed.

The design of the liquid ejection apparatus 100 will be described in more detail with reference to FIGS. 5 and 6.

Still referring to FIG. 1, a liquid circuit 50 is connected to the tank 40 and to the liquid ejection apparatus 100 for accomplishing a flow of the liquid L that is to be ejected from the primary nozzles 112 and the secondary nozzles 114, 114*a*, 114*b* into the tank 40. The liquid circuit 50 comprises, in a downstream direction, a liquid source 51, a first valve 52, a first connection point 53, a pump 54, a second connection point 55 and a second valve 58. After the second valve 58 the liquid circuit 50 is connected to the inlet 103 of the liquid line 101. A bottom of the tank 40 is connected to the liquid circuit 50 at the first connection point 53. A liquid outlet 57 is via a third valve 56 connected to the second connection point 55. A second source of liquid 60 is via a fourth valve 61 connected to the tank 40.

The pump 54 may e.g. be a gear pump, a lube pump, a centrifugal pump or a pump of any other suitable type. The valves 52, 56, 58, 61 may be butterfly valves, globe valves or valves of any other suitable type. A liquid from the liquid source 51 is typically a liquid to be mixed in or processed in the tank 40 or a liquid that constitutes a major part of a liquid to be mixed in or processed in the tank 40. A liquid content of the second source of liquid 60 may be a liquid to be mixed with the liquid from the liquid source 51, or may be a liquid to be used for cleaning of the tank 40. Additional liquid sources, not shown, may be connected to the tank 40, as required by the mixing or cleaning application at hand.

By opening the first valve 52 and by closing the second valve 58 and the third valve 56 (or having the pump 54 inactive, depending on pump type), liquid may be fed from the liquid source 51 and into the tank 40 via the first connection point 53. In this way the tank 40 may be filled with a liquid content. When the liquid ejection system 2 shall perform mixing, the tank 40 is typically filled to such a liquid content in the tank 40 completely covers the liquid ejection apparatus 100 or at least rotary head 106 including all its nozzles 112, 114, 114*a*. 114*b*.

By closing the first valve 52 and the third valve 56, and at the same time opening the second valve 58 and operating the pump 54, the liquid content of the tank 40 may be circulated via the liquid circuit 50 and the liquid ejection apparatus 100. This circulation effects mixing of a liquid content since liquid L then is ejected into the liquid content, which efficiently causes the liquid content to be stirred and mixed.

By closing the first valve 52 and the second valve 58, and at the same time opening the third valve 56 and operating the pump 54, liquid content may be expelled from the tank 40 by transporting the liquid content to the liquid outlet 57. In this context, when liquid content is expelled, some content is typically still present in the tank 40, i.e. expelling a liquid content does not necessarily mean that every part of the liquid content in the tank 40 is completely removed from the tank 40. Content that is present in the tank 40 after the expelling is typically cleaned of in a cleaning process performed by the liquid ejection apparatus 100.

The liquid content of the second source of liquid 60 may be introduced in the tank 40 by opening the fourth valve 61. If this is done during a mixing operation the liquid content of the second source of liquid 60 is efficiently mixed into the content of the tank 40.

When the liquid ejection system 2 shall effect cleaning of the tank 40 the liquid content of the second source of liquid 60 may be a cleaning liquid. Then the cleaning liquid is introduced into the tank 40 after the (mixed) liquid content is expelled. Cleaning is then effected by closing the first valve 52 and the third valve 56, and at the same time opening the second valve 58 and operating the pump 54. The liquid L is then acts as a cleaning liquid which is expelled, ejected or sprayed into the tank 40 by means of the liquid ejection apparatus 100 and hits the inner surface 41 of the tank 40. The liquid L so hitting the inner surface 41 of the tank 40 effects cleaning of the inner surface 41. Generally, when cleaning is effected the cleaning liquid in the tank 40 does not cover the liquid ejection apparatus 100, meaning that the rotary head 106 and rotary nozzle hub 110 are then not submersed in a liquid content. Instead, the liquid is ejected in a predetermined pattern towards the interior surface 41 of the tank 40 and towards an external surface 105*c* of the base member 105. In practice, the liquid will be ejected in a predetermined pattern onto the interior surface 41 of the tank 40 and onto the external surface 105*c* of the base member 105, given that a sufficient pressure of the liquid L is utilized.

To control the liquid ejection system 2 the processing unit 30 has a central processing unit 31 (CPU) that is connected to and controls an electronic input/output interface 36 (I/O). The I/O interface 36 is in turn electrically connected to the pump 54 to provide a control signal Sp. The CPU 31 is preferably a central processing unit or microprocessor of a conventional type and represents the portion of the processing unit 30 that is capable of carrying out instructions of a computer program which is stored in a memory unit 32 of the processing unit 30. The CPU 31 is the primary element carrying out the functions of the processing unit 30. Moreover, the processing unit 30 may be configured to control the valves 52, 56, 58, 61 of the liquid circuit 50 such that a flow of the liquid L in the liquid circuit 50 may be controlled.

The liquid ejection apparatus 100 is as indicated above driven by a flow of the liquid L, meaning that the liquid ejection apparatus 100 is operated by operating the pump 54 when the valves 52, 56, 58, 61 are in there desired states as discussed above.

When liquid is ejected from the primary nozzles 112 and the secondary nozzles 114, 114*a*, 114*b* for cleaning the interior surface 41 of the tank 40, then the rotary nozzle hub 110 rotates about the first axis A1 and the second axis A2. The liquid is consequently ejected as spray beams and/or jet beams in a predetermined pattern onto the interior surface 41. The primary nozzles 112 generally cause a major cleaning effect of the interior surface 41 of the tank 40, whereas the secondary nozzles generally cause a minor cleaning effect or no cleaning effect of the interior surface 41 of the tank 40.

Figure 4:
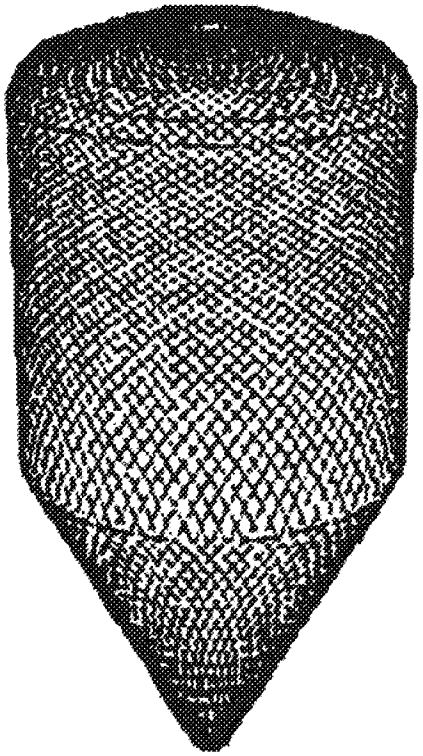
FIGS. 2-4 illustrate a principal predetermined pattern of ejected liquid as generated by the liquid ejection apparatus of the liquid ejection system in FIG. 1 at three consecutive time points.
Figure 3:
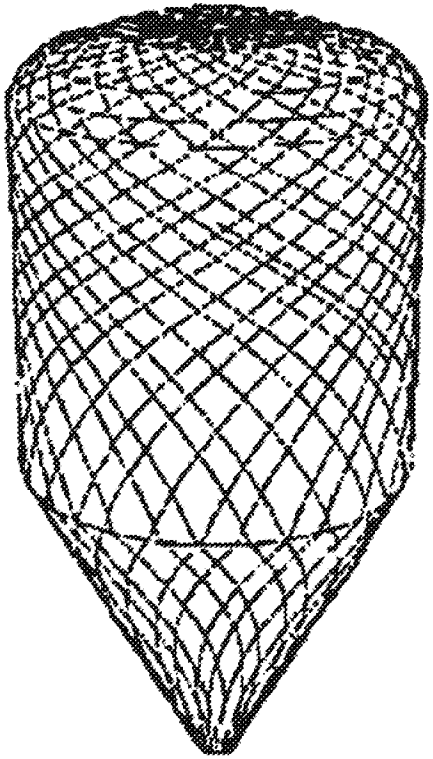
Figure 2:
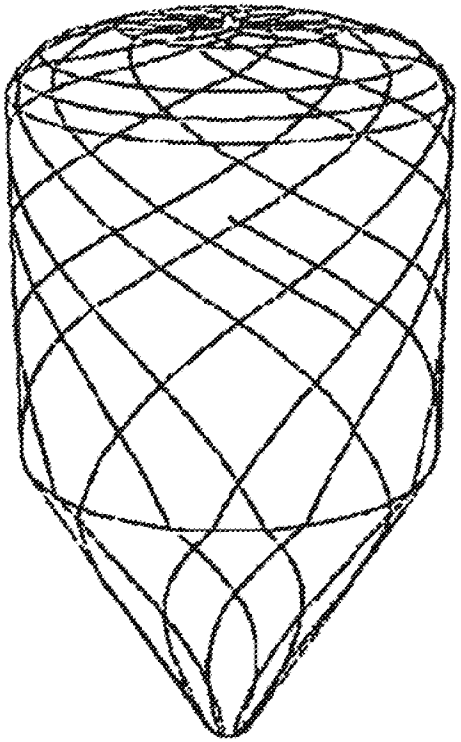

FIGS. 2-4 illustrate an example of such a predetermined pattern of the liquid L ejected from the primary nozzles 112. The coarse pattern in FIG. 2 may be achieved by the primary nozzles 112 after e.g. 1 minute, the denser pattern in FIG. 3 after 2.5 minutes, and a so-called full pattern as in FIG. 4 after 7 minutes. When the liquid ejection system 2 performs mixing the rotary hub 110 rotates about the first axis A1 and the second axis A2 as when cleaning is performed. However, when mixing the liquid L generally does not hit or impinge on the interior surface 41 of the tank 40, but is instead injected directly into a content of the tank 40. Still, the direction of the injection of the liquid L by the primary nozzles 112 follows the same pattern as shown in FIGS. 2-4.

The design of the liquid ejection apparatus 100 of FIG. 1 will now be described in more detail with reference to FIGS. 5 and 6 in combination with FIG. 1. The liquid ejection apparatus 100 shown in FIGS. 5 and 6 comprises the base member 105 for receiving the liquid L from the liquid line 101, as shown in FIG. 1. The base member 105 has as described above a first end 105*a* and a second end 105*b*. An outer circumference Cbm of a section 105*d* of the base member 105 increases in a direction towards the second end 105*b*. As can be seen, the outer circumference Cbm increases in a direction towards the second end 105*b* over a lower section of the base member 105, whereas the outer circumference Cbm is substantially constant over an upper section of the base member 105. Hence, the outer circumference Cbm of at least one section of the base member 105 and not an outer circumference of the entire base member 105 increases in a direction towards the second end 105*b*. The base member 105 may have different shapes, meaning that the outer circumference Cbm may vary in different ways. The outer circumference Cbm of the base member 105 may for instance increase towards the second end 105*b* throughout its entire length. Further, the outer circumference Cbm may for instance increase over a section towards the second end 105*b* but may decrease over another section towards the second end 105*b*. Hence, the outer circumference Cbm may vary in any suitable way, as long as it, for at least one section of the base member 105, increases in a direction towards the second end 105*b*.

The rotary head 106 is rotatably connected to the second end 105*b* of the base member 105. The rotary head 106 is connected to the base member 105 by means of the first bearing 122.

The rotary nozzle hub 110 is in turn rotatably connected to the rotary head 106 by means of the second bearing 124. The rotary nozzle hub 110 comprises primary liquid ejection nozzles 112 for ejecting the liquid L. The rotary nozzle hub 110 also comprises secondary liquid ejection nozzles 114, 114*a*. 114*b*. The rotary head 106 is rotatable about the first geometrical axis A1. The rotary nozzle hub 110 is rotatable about the second geometrical axis A2. In the depicted embodiment, the second axis A2 is arranged at an angle β of 90° relative the first axis A1, as described above. However, the angle β may be of a different value. As long as the first axis A1 and the second axis A2 are arranged at an angle β in relation to each other, the liquid ejection apparatus will eject the liquid L in a three-dimensional pattern towards an interior surface 41 of the tank 40 when the rotary head 106 and the rotary nozzle hub 110 are rotated about their respective rotation axes A1, A2. The angle β is preferably 80°-100° but other angle values may be used.

When the liquid L enters the liquid ejection apparatus 100 at the first end 105*a* of the base member 105, the liquid L is directed through the base member 105 and further into the rotary head 106. From the rotary head 106, the liquid is directed further into the rotary nozzle hub 110, and more specifically into an internal cavity 110*b* of the rotary nozzle hub 110. From the internal cavity 110*b* the liquid L flows into the primary liquid ejection nozzles 112 and the secondary liquid ejection nozzles 114, 114*a*, 114*b*. The liquid L is then ejected as spray beams or jet beams from the primary liquid ejection nozzles 112 and the secondary liquid ejection nozzles 114, 114*a*, 114*b*.

The rotation of the rotary head 106 and the rotary nozzle hub 110 about their respective axes A1, A2 is realized by means of a drive system 130. The drive system is powered by the flow of the liquid L entering the base member 105 at the first end 105*a*. In order to achieve the rotation, an impeller 132 is arranged in a flow path of the liquid L, e.g. after the liquid inlet at the first end 105*a* of the base member 105. In other words, the impeller 132 is arranged inside the base member 105. A rotation of the impeller 132 is induced by the flow the liquid L that passes by the impeller 132. The impeller 132 may be located in other locations, such as in the liquid line 101, i.e. in an upstream direction of the liquid ejection apparatus 100. The impeller 132 drives a gearbox 134 in form of a planetary or epicyclic gear. The gearbox 134 reduces a rotation speed as received by impeller 132, resulting in a suitable rotation speed of the rotary head 106. The skilled person realizes that any suitable kind of gearbox may be used. The rotary nozzle hub 110 will rotate about the second axis A1 as a planetary gear of the gearbox 134 rotates, by virtue of a toothed surface 136 of the rotary nozzle hub. The toothed surface 136 is implemented and operates in cooperation with the planetary gear of the gearbox 134 according to conventional techniques within the field of liquid ejection apparatuses. Any suitable technique for arranging the impeller 132 and for transferring a rotational movement of the impeller 132 to the rotary head 106 and the rotary nozzle hub 110 may be employed. Alternatively, an impeller as described in patent document WO92/04994 may be used for accomplishing the rotations about the first axis A1 and the second axis A2.

Further, the rotation about the first axis A1 may be accomplished via a shaft, not shown, that extends from an upper end of the liquid line 101 and to the rotary head 106 where it is connected to the rotary head 106. The shaft then preferably has a diameter that is smaller than both an inner diameter of the liquid line 101, an inner diameter of the base member 105 and a diameter of an opening at an inlet end of the rotary head 106. This arrangement will allow the liquid L to flow past the shaft. Hence, when the shaft is rotated, the rotary head 106 will be rotated about the first axis A1. Such a shaft may also be used to drive the rotation of the rotary nozzle hub 110 about the second axis A2 through a gearbox. Such a shaft may be powered by e.g. an electrical motor or any other suitable power source.

Preferably, the rotation of the rotary head 106 about the first axis A1 has a rotational speed of 0.2 to 6 rpm, and the rotation of the rotary nozzle hub 110 about the second axis A2 has at a rotational speed of 0.2 to 10 rpm. The rotary head 106 and the rotary nozzle hub may be arranged to rotate in any direction about the respective axes A1, A2.

When the pump 54 pumps the liquid L through the liquid ejection apparatus 100, the liquid L will be ejected through the primary liquid ejection nozzles 112 and the secondary liquid ejection nozzles 114, 114*a*, 114*b* providing liquid jets. Preferably, the pump 54 that feeds the liquid L into the liquid ejection apparatus 100 at a pressure of 1 to 9 bar and at a flow rate of 10 to 250 liters per minute.

In the illustrated embodiment four primary nozzles 112 are symmetrically arranged on the rotary nozzle hub 110. It is however possible to have e.g. only one primary nozzle 112 on the rotary hub 110. It is also possible to have two, three or more than four primary liquid ejection nozzles 112 on the rotary nozzle hub 110. If more than one primary liquid ejection nozzle 112 is arranged on the rotary nozzle hub 110 these nozzles 112 may be identical or different.

The liquid L ejected by the secondary liquid ejection nozzles 114, 114*a*, 114*b* will be ejected in a pattern towards the internal surface 41 of the tank 40 as well as in a pattern towards the external surface 105*c* of the base member 105. This means that the liquid Las ejected by the secondary liquid ejection nozzles 114, 114*a*, 114*b* will impinge on the internal surface 41 of the tank 40 during cleaning of the tank 40 as well as on the external surface 105*c* of the base member 105, given that a sufficient liquid pressure is used. In the depicted embodiment, one of the secondary liquid ejection nozzles 114*b* is directed such that the liquid L ejected by the secondary liquid ejection nozzle 114*b* is, during at least a part of a revolution of the rotary nozzle hub 110, ejected in a pattern towards an external surface of the liquid line 101. This arrangement of the secondary liquid ejection nozzle 114*b* will be described in more detail hereinafter.

When the tank 40 is cleaned, the liquid ejection apparatus 100 is generally arranged above a surface of a content in the tank 40 as described above. On the other hand, if the liquid ejection apparatus 100 is arranged below a surface of a content in the tank 40, the liquid ejection apparatus 100 will mix the content of the tank as described above. Generally the primary liquid ejection nozzles 112 will foresee a primary or major cleaning effect of the internal surface 41 of the tank 40, whereas the secondary liquid ejection nozzles 114, 114*a*, 114*b* generally will foresee a secondary or minor cleaning effect of the internal surface 41 of the tank 40. However, as the secondary liquid ejection nozzles 114, 114*a*, 114*b* are directed towards the base member 105 (and the liquid line 101), the secondary liquid ejection nozzles 114, 114*a*, 114*b* will provide a cleaning effect of the liquid ejection apparatus 100 itself.

In the illustrated embodiment four secondary nozzles 114, 114*a*, 114*b* are symmetrically arranged on the rotary nozzle hub 110. It is however possible to have e.g. only one secondary liquid ejection nozzle 114, 114*a*, 114*b* on the rotary hub 110. It is also possible to have two, three or more than four secondary liquid ejection nozzles 114, 114*a*, 114*b* on the rotary nozzle hub 110. If more than one secondary liquid ejection nozzle 114, 114*a*, 114*b* is arranged on the rotary nozzle hub 110 these nozzles 114, 114*a*. 114*b* may be identical or different, as will be described in more detail hereinafter.

As described above, in the illustrated embodiment four primary nozzles 112 and four secondary nozzles 114, 114*a*, 114*b* are symmetrically arranged on the rotary nozzle hub 110. The primary nozzles 112 arranged on the rotary nozzle hub 110, such that interspaces 110*e* are formed between the primary liquid ejection nozzles 112. The secondary liquid ejection nozzles (114, 114*a*, 114*b*) are located on a respective interspace (110*e*) of the interspaces (110*e*) between the primary liquid ejection nozzles (112).

In the following, the primary liquid ejection nozzles 112 will be described. The primary liquid ejection nozzles 112 comprises each, as seen in a direction from an inlet 113*b*, a cylindrical section 112*c* followed by section 112*t* that is tapered in a direction towards an outlet 113*a* of the primary liquid ejection nozzles 112. The tapered section 112*t* is provided with an outer concave surface 112*s*. The outer concave surface 112*s* is concave in the sense that a cross section of the primary liquid ejection nozzle 112 along a longitudinal direction thereof exhibits a concave portion defining the cross section. The tapered section 112*t* may be of a different shape or taper in a different way. Moreover, in some embodiments the primary liquid ejection nozzles 112 may have any suitable form and may consequently be e.g. uniform thickness or have several different sections varying in thickness. Further, the outlets 113*a* of the respective primary liquid ejection nozzles 112 may have any suitable shape or size, for providing a desired liquid jet. For instance, the outlets 113*a* may have a circular, a square or an oval cross section. The outlets 113*a* may be accomplished according to any conventional technique within the field of tank cleaning and mixing apparatuses.

In the depicted embodiment, the cylindrical section 112*c* is provided with a planar cut-out 112*p* for allowing a tool, such as an adjustable spanner, to engage the primary liquid ejection nozzles 112 for fastening and releasing the primary liquid ejection nozzles 112 to and from the rotary nozzle hub 112. The connection of the liquid ejection nozzles 112 to the rotary nozzle hub 110 may be accomplished according to any conventional technique within the field tank cleaning and mixing apparatuses.

The outer concave surface 112*s* of the primary liquid ejection nozzles 112 allows for an enhanced self cleaning of the primary liquid ejection nozzles 112. This is achieved by providing a gap 120 located between the base member 105 and the rotary head 106. The gap 120 allows an amount of the liquid L to flow out through the gap 120. The flow of liquid flowing out of the gap 120 is after exiting the gap 120 directed in a direction substantially parallel to the second axis A2, i.e. in a rightward direction of FIG. 6, by means of a bulging outer surface section or curved section 106*s* of the rotary head 106. In other words, the bulging outer surface section 106*s* directs the flow of liquid exiting the gap 120 in a direction towards the primary liquid ejection nozzles 112. The respective outer concave surfaces 112*s* of the primary liquid ejection nozzles 112 are positioned such that the flow of liquid from the gap 120 impinges on the outer concave surfaces 112*s* of the primary liquid ejection nozzles 112 during at least a part of a revolution of the rotary nozzle hub 110. In other words, the flow of liquid from the gap 120 impinges on the respective outer concave surfaces 112*s* as the primary liquid ejection nozzles 112 are rotating, by virtue of the liquid (L) form the gap 120 that is directed by the bulging outer surface section 106*s* towards the concave surfaces 112*s*. When hit by liquid that originally came from the gap 120 outer concave surfaces 112*s* of the primary liquid ejection nozzles 112 directs the flow of liquid in a direction towards the outlet 113*a* of the respective primary liquid ejection nozzles 112, thereby providing a cleaning effect to the respective primary liquid ejection nozzles 112. The shape of the bulging outer surface section 106*s* may be varied to direct the flow of liquid exiting the gap 120 in other directions. However, the bulging outer surface section 106*s* should preferably have a shape such that the flow of liquid from the gap 120 impinges on the outer concave surfaces 112*s* of the primary liquid ejection nozzles 112 during at least a part of a revolution of the rotary nozzle hub 110.

Figure 7:
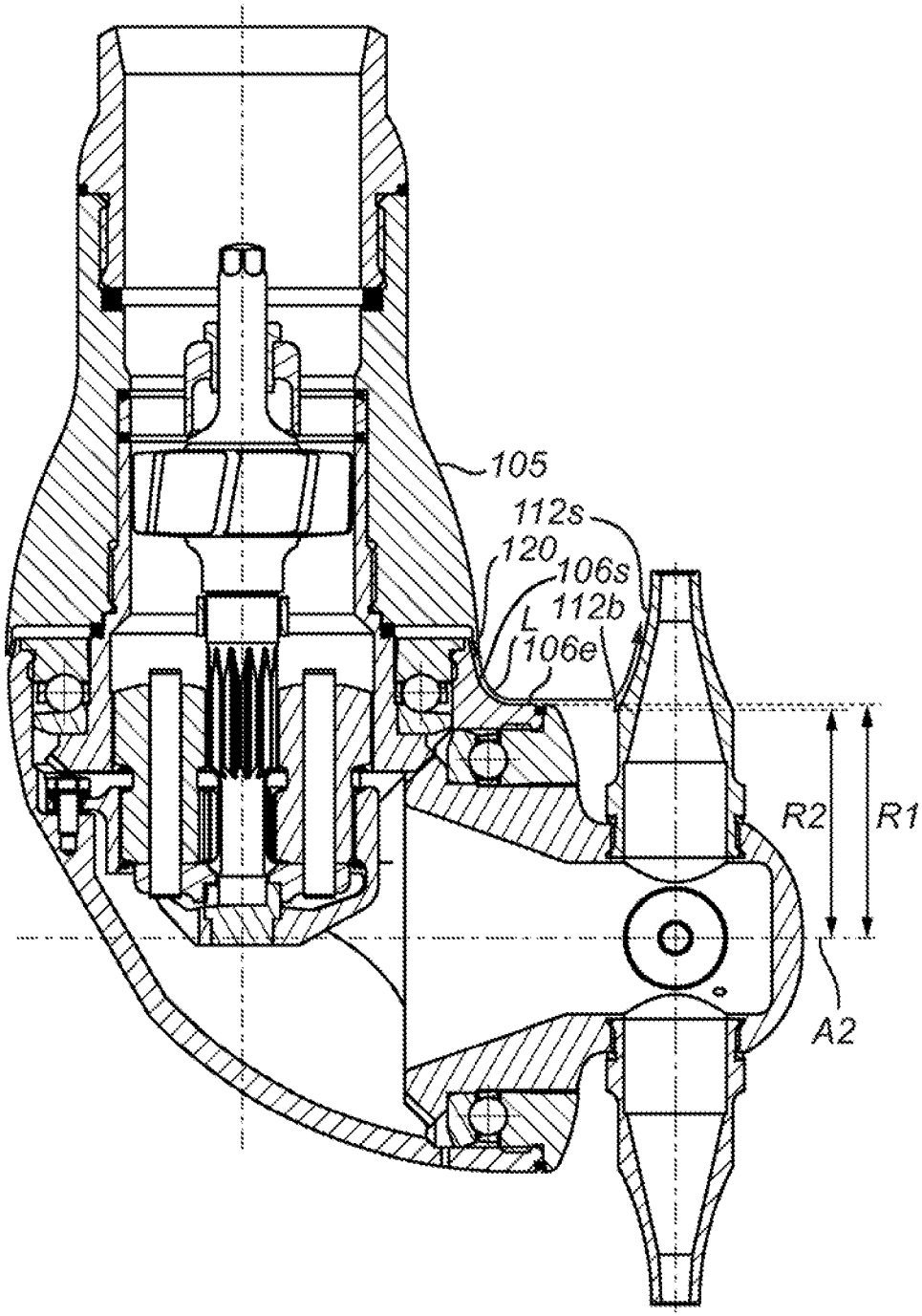
FIG. 7 is a second cross sectional side view of the liquid ejection apparatus of FIG. 1.

In detail and with further reference to FIG. 7, liquid L that comes from the gap 12 is by the surface section 106*s* directed towards a liquid exit surface 106*e* of the rotary head 106. The liquid exit surface 106*e* has a tangential direction that directs the liquid L towards the concave surface 112*s* of the primary liquid ejection nozzle 112, during at least a part of a revolution of the rotary nozzle hub 110. The concave surface 112*s* has a starting point 112*b* from where the concave surface 112*s* starts to extend towards the outlet 113*a*. The liquid exit surface 106*e* may be located at a first distance R1 from the second geometrical axis A2, and the starting point 112*b* may be located at a second distance R2 from the second geometrical axis A2. The first distance R1 is preferably larger than the second distance R2.

For instance, the bulging outer surface section 106*s* may be inclined in a downward direction, meaning that the flow of liquid exiting the gap 120 will be directed downwards. Further, the bulging outer surface section 106*s* may be inclined in an upward direction, meaning that the flow of liquid exiting the gap 120 will be directed upwards. This may for instance be achieved by providing a bump, not shown, where the flow of liquid exiting the gap 120 leaves the bulging outer surface section 106*s*.

In the following, the configuration of the secondary liquid ejection nozzles 114, 114*a*, 114*b* will be described. In the depicted embodiment, the secondary liquid ejection nozzles 114, 114*a*, 114*b* are provided as through holes in the wall 110*a* of the rotary nozzle hub 110. The secondary liquid ejection nozzles 114, 114*a*, 114*b* may be provided as bores, cased holes or similar. The through holes making up the secondary liquid ejection nozzles 114, 114*a*, 114*b* are thus extending between the internal cavity 110*b* of the rotary nozzle hub 110 and an external surface 110*c* of the rotary nozzle hub 110. The respective ends of the trough holes making up the secondary liquid ejection nozzles 114, 114*a*, 114*b* are thus acting as inlets 115*b* and outlets 115*a* of the respective secondary liquid ejection nozzles 114, 114*a*, 114*b*.

In the depicted embodiment, the outlets 115*a* of the of the respective secondary liquid ejection nozzles 114, 114*a*, 114*b* are in flush with the external surface 110*c* of the rotary nozzle hub. The holes making up the respective secondary liquid ejection nozzles 114, 114*a*, 114*b* may be of any suitable shape or size. For instance, the holes may be circular, square shaped, oval or the like. Further, a relatively large hole may be formed, where the hole is subsequently provided with an insert, not shown. By providing an insert, the size, shape and location of the outlets 115*a* may be altered. Moreover, the use of an insert allows for efficient replacement in case the insert gets damaged or negatively affected in any other way. Also when using an insert, the outlet 115*a* may be arranged in flush with the external surface 110*c* of the rotary nozzle hub 110.

Preferably, the primary liquid ejection nozzles 112 have outlets 113*a* that are larger than the outlets 115*a* of the secondary liquid ejection nozzles 114, 114*a*, 114*b*, such that a liquid flow through the primary liquid ejection nozzles 112 is at least 8 times greater than a liquid flow through the secondary liquid ejection nozzles 114, 114*a*, 114*b*.

Any suitable relation between the liquid flow through the primary liquid ejection nozzles 112 and the liquid flow through the secondary liquid ejection nozzles 114, 114*a*, 114*b* may be used.

In the depicted embodiment, the inlets 113*b* of the primary liquid ejection nozzles 112 and the inlets 115*b* of the secondary liquid ejection nozzles 114, 114*a*, 114*b* are formed in a wall 110*a* of the internal cavity 110*b*, meaning that the respective nozzles 112, 114, 114*a*, 114*b* all have individual inlets 113*b*, 115*b* at the internal cavity 110*b*. This means also that all inlets 113*b*, 115*b* for the respective nozzles 112, 114, 114*a*, 114*b* are during use provided with liquid L from the internal cavity 110*b* of the rotary nozzle hub 110.

In the depicted embodiment, a first secondary liquid ejection nozzle 114*a* is inclined towards the rotary head 106 with an angle $\alpha$ of 56° relative a radial direction Dr of the rotary nozzle hub 110. This means that the liquid L ejected by the first secondary liquid ejection nozzle 114*a* will, during at least a part of a revolution of the rotary nozzle hub 110, be ejected in a pattern towards the external surface 105*c* of the base member 105, as described above. Preferably the first secondary liquid ejection nozzle 112*a* is inclined towards the rotary head 106 with an angle α of 10° to 50°. However, any other angles α may be used.

In the depicted embodiment, a second, secondary liquid ejection nozzle 114*b* is inclined towards the rotary head 106 with an angle α of 5° relative the radial direction Dr of the rotary nozzle hub 110. This means that the liquid L ejected by the second, secondary liquid ejection nozzle 114*b* will, during at least a part of a revolution of the rotary nozzle hub 110, be ejected in a pattern towards an external surface of the liquid line 101 that extends into the tank 40. Of course, this assumes that the liquid line 101 is sufficiently long to be hit by the liquid L (an angle α of 5° is a value that is suitable for most tank cleaning implementations). Preferably the second secondary liquid ejection nozzle 112*a* is inclined towards the rotary head 106 with an angle α of 1° to 10°. However, any other angles α may be used as long as the liquid line 101 is hit by the liquid L.

In the depicted embodiment there are four secondary liquid ejection nozzles 114, 114*a*, 114*b*. Preferably, the four secondary liquid ejection nozzles 114, 114*a*, 114*b* are arranged at the angles α of 2.8°, 5°, 56° and 56°, which brings about that the liquid L ejected by two of the secondary liquid ejection nozzles 114, 114*a* (56° and 56°) will, during at least a part of a revolution of the rotary nozzle hub 110, be ejected in a pattern towards the external surface 105*c* of the base member 105, and that the liquid L ejected by the remaining two secondary liquid ejection nozzles 114, 114*b* (2.8° and 5°) will, during at least a part of a revolution of the rotary nozzle hub 110, be ejected in a pattern towards the external surface of the liquid line 101 that extends into the tank 40, at two different locations on the liquid line 101.

A shortest distance Ds from a central, longitudinal axis A1 of the base member 105 and the secondary liquid ejection nozzles 114, 114*a*, 114*b* may be between 65 and 120 mm.

A circumference Crh of the rotary head 106 may, at an end 106*a* of the rotary head 106 facing the rotary nozzle hub 110, be at least 20% larger than a circumference Cnh of the rotary nozzle hub 110, at an end 110*d* of the rotary nozzle hub 110 facing the rotary head 106. However, other relationships between the circumferences Crh, Cnh may be used.

The secondary liquid ejection nozzles 114, 114*a*, 114*b* and connections between the primary liquid ejection nozzles 112 and the rotary nozzle hub 110 may be arranged on an annular envelope surface Sae of the rotary nozzle hub 110, as is the case with the depicted embodiment. A width Wae of the annular envelope surface Sae may be equal to or smaller than an outer width Wpn of the primary liquid ejection nozzles 112 at least one of the connections between the primary liquid ejection nozzles 112 and the rotary nozzle hub 110. By arranging the secondary liquid ejection nozzles 114, 114*a*, 114*b* and the connections between the primary liquid ejection nozzles 112 and the rotary nozzle hub 110 on an envelope surface Sae having a limited width Wpn, a liquid ejection apparatus 100 having a limited extension along the second geometrical axis A2 may be realized.

In the depicted embodiment, the inlets 115*b* of the secondary liquid ejection nozzles 114, 114*a*, 114*b* and the inlets 113*b* of the primary liquid ejection nozzles 112 are arranged within an imaginary, disk shaped volume Vd. The disk shaped volume Vd is centered on and extending from the second geometrical axis A2, as shown in FIGS. 5 and 6. The disk shaped volume Vd has a width Wd that is equal to an outer width Wpn of at least one of the primary liquid ejection nozzles 112 at a connection between the primary liquid ejection nozzle 112 and the rotary nozzle hub 110. The disc shaped volume Vd typically has a radius that extends from the second geometrical axis A2, and at least just past (e.g. 1 mm past) the outlets 113*a* of the primary liquid ejection nozzle 112. Further, the disk shaped volume Vd encloses the connection between the primary liquid ejection nozzle 112 and the rotary nozzle hub 110. This arrangement of the respective inlets 113*b*, 115*b* of the respective nozzles 112, 114, 114*a*, 114*b* brings about that all inlets are provided at the internal cavity 110*b* along a limited distance as seen along the second geometrical axis A2, which brings about that a compact design of the liquid ejection apparatus 100 may be achieved as discussed above. The respective inlets 113*b*, 115*b* of the respective nozzles 112, 114, 114*a*, 114*b* may in other embodiments be provided in different locations not limited by the disk shaped volume Vd.

In the depicted embodiment, the outlets 115*a* of the secondary liquid ejection nozzles 114, 114*a*. 114*b* and the outlets 113*a* of the primary liquid ejection nozzles 112 are arranged within the disk shaped volume Vd described above. This arrangement of the respective outlets 113*a*, 115*a* of the respective nozzles 112; 114, 114*a*, 114*b* brings about that all outlets 113*a*, 115*a* are provided along a limited distance as seen along the second geometrical axis A2, which brings about that a compact design of the liquid ejection apparatus 100 may be achieved as discussed above.

Even though the invention has been described with reference to specific exemplifying embodiments thereof, many different alterations, modifications and the like will become apparent for those skilled in the art. Variations to the disclosed embodiments may be understood and effected by the skilled addressee in practicing the claimed invention, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A liquid ejection apparatus for cleaning of a tank, the liquid ejection apparatus being configured to be attached to a liquid line that extends into the tank, and to receive a liquid from the liquid line, the liquid ejection apparatus comprising:

a base member having a first end for receiving the liquid from the liquid line, and a second end, wherein an outer circumference of a section of the base member increases in a direction towards the second end, a rotary head that is rotatably connected to the second end of the base member, a rotary nozzle hub that is rotatably connected to the rotary head and comprises a primary liquid ejection nozzle for ejecting the liquid, the rotary head being rotatable about a first geometrical axis and the rotary nozzle hub being rotatable about a second geometrical axis that is arranged at an angle relative to the first geometrical axis, such that the liquid ejected by the primary liquid ejection nozzle is ejected in a pattern towards an interior surface of the tank, the rotary nozzle hub possessing an annular exterior surface, wherein the rotary nozzle hub comprises a secondary liquid ejection nozzle that is configured to, during at least a part of a revolution of the rotary nozzle hub, eject the liquid in a pattern towards an external surface of the base member, the secondary liquid ejection nozzle being a through hole in a wall of the rotary nozzle hub, the through hole having an outlet that opens to the annular exterior surface of the rotary nozzle hub so that an entire circumference of the outlet of the through hole is flush with the annular exterior surface of the rotary nozzle hub.

2. Liquid ejection apparatus according to claim 1, wherein the primary liquid ejection nozzle has an outlet that is larger than an outlet of the secondary liquid ejection nozzle, such that a liquid flow through the primary liquid ejection nozzle is at least 8 times greater than a liquid flow through the secondary liquid ejection nozzle.

3. Liquid ejection apparatus according to claim 1, wherein a connection between the primary liquid ejection nozzle and the rotary nozzle hub is arranged on the annular exterior surface of the rotary nozzle hub, the annular exterior surface having a width that is equal to or smaller than an outer width of the primary liquid ejection nozzle at the connection between the primary liquid ejection nozzle and the rotary nozzle hub.

4. Liquid ejection apparatus according to claim 1, wherein the rotary nozzle hub comprises an internal cavity in liquid communication with the rotary head, wherein an inlet of the secondary liquid ejection nozzle and an inlet of the primary liquid ejection nozzle are separated from each other and formed in a wall of the internal cavity.

5. Liquid ejection apparatus according to claim 1, wherein an inlet of the secondary liquid ejection nozzle and an inlet of the primary liquid ejection nozzle are arranged within a disk shaped volume centered on and extending radially and perpendicularly from the second geometrical axis, and having a width that is equal to an outer width of the primary liquid ejection nozzle at a connection between the primary liquid ejection nozzle and the rotary nozzle hub.

6. Liquid ejection apparatus according to claim 1, wherein an outlet of the secondary liquid ejection nozzle and an outlet of the primary liquid ejection nozzle are arranged within a disk shaped volume centered on and extending radially and perpendicularly from the second geometrical axis, and having a width that is equal to an outer width of the primary liquid ejection nozzle at a connection between the primary liquid ejection nozzle and the rotary nozzle hub.

7. Liquid ejection apparatus according to claim 1, wherein the primary liquid ejection nozzle has an outer, concave surface that faces the rotary head.

8. Liquid ejection apparatus according to claim 7, comprising a gap located between the base member and the rotary head, for allowing an amount of the liquid to flow out from the gap, wherein the outer, concave surface of the primary liquid ejection nozzle is positioned such that a flow of the liquid from the gap impinges on the outer, concave surface of the primary liquid ejection nozzle during at least a part of a revolution of the rotary nozzle hub.

9. Liquid ejection apparatus according to claim 8, wherein the gap directs the liquid towards a curved section of the rotary head, the curved section directing the liquid towards a liquid exit surface of the rotary head, the liquid exit surface having a tangential direction that directs the liquid towards the concave surface of the primary liquid ejection nozzle, during at least a part of a revolution of the rotary nozzle hub.

10. Liquid ejection apparatus according to claim 1, wherein the liquid ejection apparatus comprises a plurality of primary liquid ejection nozzles that are arranged on the rotary nozzle hub, such that interspaces are formed between the primary liquid ejection nozzles, and a plurality of secondary liquid ejection nozzles that are located on a respective interspace of the interspaces between the primary liquid ejection nozzles.

11. Liquid ejection apparatus according to claim 1, comprising a plurality of secondary liquid ejection nozzles, wherein a first, secondary liquid ejection nozzle is inclined towards the rotary head with an angle of 10° to 50° relative the first geometrical axis, such that that liquid ejected by the first, secondary liquid ejection nozzle is, during at least a part of a revolution of the rotary nozzle hub, ejected in a pattern towards an external surface of the base member, and wherein a second, secondary liquid ejection nozzle is inclined towards the rotary head with an angle of 1° to 10° relative the first geometrical axis, such that liquid ejected by the second, secondary liquid ejection nozzle is, during at least a part of a revolution of the rotary nozzle hub, ejected in a pattern towards an external surface of the liquid line that extends into the tank.

12. Liquid ejection apparatus according to claim 1, wherein a shortest distance from a central, longitudinal axis of the base member and the secondary liquid ejection nozzle is between 65 and 120 mm.

13. Liquid ejection apparatus according to claim 1, wherein a circumference of the rotary head is, at an end of the rotary head facing the rotary nozzle hub, at least 20% larger than a circumference of the rotary nozzle hub, at a section of the rotary nozzle hub where the rotary nozzle hub meets the rotary head.

14. A liquid ejection apparatus for cleaning of a tank, the liquid ejection apparatus being configured to be attached to a liquid line that extends into the tank, and to receive a liquid from the liquid line, the liquid ejection apparatus comprising:

a base member having a first end for receiving the liquid from the liquid line, and a second end, wherein an outer circumference of a section of the base member increases in a direction towards the second end, a rotary head that is rotatably connected to the second end of the base member, a rotary nozzle hub that is rotatably connected to the rotary head and comprises a primary liquid ejection nozzle for ejecting the liquid, the rotary head being rotatable about a first geometrical axis and the rotary nozzle hub being rotatable about a second geometrical axis that is arranged at an angle (β) relative to the first geometrical axis, such that the liquid ejected by the primary liquid ejection nozzle is ejected in a pattern towards an interior surface of the tank, and wherein the primary liquid ejection nozzle has an outer, concave surface that faces the rotary head.

15. Liquid ejection apparatus according to claim 14, comprising a gap located between the base member and the rotary head, for allowing an amount of the liquid to flow out from the gap, wherein the outer, concave surface of the primary liquid ejection nozzle is positioned such that a flow of the liquid from the gap impinges on the outer, concave surface of the primary liquid ejection nozzle during at least a part of a revolution of the rotary nozzle hub.

16. Liquid ejection apparatus according to claim 15, wherein the gap directs the liquid towards a curved section of the rotary head, the curved section directing the liquid towards a liquid exit surface of the rotary head, the liquid exit surface having a tangential direction that directs the liquid towards the concave surface of the primary liquid ejection nozzle, during at least a part of a revolution of the rotary nozzle hub.

17. Liquid ejection apparatus according to claim 14, wherein an external envelope surface of the primary liquid ejection nozzle has a first circumference at any first radial distance from the rotary nozzle hub and a second circumference that is equal to or smaller than the first circumference, at any second radial distance from the rotary nozzle hub, the second radial distance being larger than the first radial distance.

18. A liquid ejection apparatus for cleaning of a tank, the liquid ejection apparatus being configured to be attached to a liquid line that extends into the tank, and to receive a liquid from the liquid line, the liquid ejection apparatus comprising:

a base member having a first end for receiving the liquid from the liquid line, and a second end, wherein an outer circumference of a section of the base member increases in a direction towards the second end, a rotary head that is rotatably connected to the second end of the base member, a rotary nozzle hub that is rotatably connected to the rotary head and comprises a primary liquid ejection nozzle for ejecting the liquid, the rotary head being rotatable about a first geometrical axis and the rotary nozzle hub being rotatable about a second geometrical axis that is arranged at an angle relative to the first geometrical axis, such that the liquid ejected by the primary liquid ejection nozzle is ejected in a pattern towards an interior surface of the tank, wherein the rotary nozzle hub comprises a plurality of secondary liquid ejection nozzles, the plurality of secondary liquid ejection nozzles comprising a first secondary liquid ejection nozzle and a second secondary liquid ejection nozzle, the first, secondary liquid ejection nozzle being inclined towards the rotary head with an angle of 10° to 50° relative the first geometrical axis, such that that liquid ejected by the first, secondary liquid ejection nozzle is, during at least a part of a revolution of the rotary nozzle hub, ejected in a pattern towards an external surface of the base member, and the second, secondary liquid ejection nozzle being inclined towards the rotary head with an angle of 1° to 10° relative the first geometrical axis, such that liquid ejected by the second, secondary liquid ejection nozzle is, during at least a part of a revolution of the rotary nozzle hub, ejected in a pattern towards an external surface of the liquid line that extends into the tank.

19. A liquid ejection apparatus for cleaning of a tank, the liquid ejection apparatus being configured to be attached to a liquid line that extends into the tank, and to receive a liquid from the liquid line, the liquid ejection apparatus comprising:

a base member having a first end for receiving the liquid from the liquid line, and a second end, wherein an outer circumference of a section of the base member increases in a direction towards the second end, a rotary head that is rotatably connected to the second end of the base member, a rotary nozzle hub that is rotatably connected to the rotary head and comprises a primary liquid ejection nozzle for ejecting the liquid, the rotary head being rotatable about a first geometrical axis and the rotary nozzle hub being rotatable about a second geometrical axis that is arranged at an angle relative to the first geometrical axis, such that the liquid ejected by the primary liquid ejection nozzle is ejected in a pattern towards an interior surface of the tank, the rotary nozzle hub possessing an annular exterior surface, the rotary nozzle hub comprising a secondary liquid ejection nozzle that is configured to, during at least a part of a revolution of the rotary nozzle hub, eject the liquid in a pattern towards an external surface of the base member, and a connection between the primary liquid ejection nozzle and the rotary nozzle hub is arranged on the annular exterior surface of the rotary nozzle hub, the annular exterior surface having a width that is equal to or smaller than an outer width of the primary liquid ejection nozzle at the connection between the primary liquid ejection nozzle and the rotary nozzle hub.

* * * * *